US011029129B1

(12) United States Patent
Lee

(10) Patent No.: US 11,029,129 B1
(45) Date of Patent: Jun. 8, 2021

(54) GUN TUNNEL SIGHT

(71) Applicant: Shanyao Lee, Santa Ana, CA (US)

(72) Inventor: Shanyao Lee, Santa Ana, CA (US)

( * ) Notice: Subject to any disclaimer, the term of this patent is extended or adjusted under 35 U.S.C. 154(b) by 0 days.

(21) Appl. No.: 16/882,641

(22) Filed: May 25, 2020

(51) Int. Cl.
*F41G 1/34* (2006.01)
*F41G 1/02* (2006.01)

(52) U.S. Cl.
CPC ..... *F41G 1/345* (2013.01); *F41G 1/02* (2013.01)

(58) Field of Classification Search
CPC ..... F41G 1/02; F41G 1/06; F41G 1/32; F41G 1/345
USPC ..... 42/132, 131, 144, 145, 111, 113
See application file for complete search history.

(56) References Cited

U.S. PATENT DOCUMENTS 3,915,552 A * 10/1975 Rickert ..... G02B 27/36 359/513

* cited by examiner

*Primary Examiner* — Reginald S Tillman, Jr.
(74) *Attorney, Agent, or Firm* — Che-Yang Chen; Law Office of Michael Chen

(57) ABSTRACT

In one aspect, a gun sight may include a main body and a light tube. In one embodiment, the main body may include an elongated light tunnel housing and a base, wherein the light tunnel housing is formed on top of the base, and a light tunnel is formed inside the light tunnel housing. The light tunnel has a front end and a rear end, and the light tube is disposed at the rear end. In one embodiment, the light tube can be a fluorescent optical fiber that can be used as a light source for the shooter's eye even when the environment is relatively dark. In other embodiments, the light tube can be an integration of optical fiber and tritium. The light tunnel is tapered from the front end to the rear end to enhances the effect of light concentration in the light tunnel.

7 Claims, 6 Drawing Sheets

GUN TUNNEL SIGHT

FIELD OF THE INVENTION

The present invention relates to an aiming device used for firearms, and more particularly relates to a gun tunnel sight in which a light source creates a light spot inside a light tunnel for better aiming at the target.

BACKGROUND OF THE INVENTION

Firearms are conventionally aimed by using a sight installed on the firearm and pointing the sight to the target point. By "target" is meant the object or person that the shooter intends to hit, and by "target point" is meant the point of the target at which the shooter aims the projectile.

Generally, the projectiles may hit any point within an area about the target point. When the sights are aligned, it defines an aim line, and when said aim line passes through the shooter's aiming eye, the axis of the firearm barrel should be substantially directed to the target point.

The accuracy of guns greatly depends on the relative orientation between the aiming line of the shooter's eye and the central axis of the gun's barrel. Since the aiming line coincides with the shooter's eye and with the target, in order to hit the target accurately, the aiming line and the central axis of the gun's barrel must be parallel. Otherwise, the bullet may deflect from the target's center.

Since any sight is mounted on top of the gun's slide, in most cases it is not perfectly aligned due to manufacturing and assembly tolerances. Therefore, it should contain an alignment mechanism, which can adjust its orientation with respect to the slide. Generally, the existing mechanisms are complex and expensive due to several alignment mechanical parts needed. Also, when using the traditional "two sights" system, you need to align "two sights" which will cause more time and human error. Therefore, it remains a need for a new and improved gun sight to overcome the problems stated above.

SUMMARY OF THE INVENTION

In one aspect, a gun sight may include a main body and a light tube. In one embodiment, the main body may include an elongated light tunnel housing and a base, wherein the light tunnel housing is formed on top of the base, and a light tunnel is formed inside the light tunnel housing.

In an exemplary embodiment, the light tunnel has a front end and a rear end, and the light tube is disposed at the rear end of the light tunnel. In one embodiment, the light tube can be a fluorescent optical fiber that can be used as a light source for the shooter's eye even when the environment is relatively dark. In other embodiments, the light tube can be an integration of optical fiber and tritium.

It is important to note that the light tunnel in the present invention is tapered from the front end to the rear end to enhances the effect of light concentration in the light tunnel. In other words, comparing with conventional gun sights, the size of the light tunnel can be shorted because it is tapered to enhance light concentration, and the size of the gun sight in the present invention can be further minimized without sacrificing the functionality thereof. It is also noted that the shape of the light tunnel is not limited to triangular. It can be circular or any other polygonal.

When in use, instead of using conventional double sights (front and rear), the user can merely dispose the gun tunnel sight on the pistol. Through the light tunnel, the shooter can see a small inner triangle at the rear end of the light tunnel, and point the pistol to the target and place target on the tip of the tunnel sight. More importantly, the shooter may need to align the inner triangle inside the light tunnel to be centrally disposed so that the inner triangle is equally spacing to all sides.

In another aspect, a method for aiming a target with a firearm may include steps of: providing a gun sight attached to a firearm; said gun sight having a main body and a light tube, the main body including an elongated tapered light tunnel housing and a base, wherein the light tunnel housing is formed on top of the base, and a light tunnel is formed inside the light tunnel housing; aiming the firearm at a selected target by slightly lifting up the firearm; placing the target at a tip portion of the gun sight; and adjusting a light spot at a rear end of the light tunnel to a center position inside the light tunnel.

DETAILED DESCRIPTION OF THE INVENTION

Figure 1:
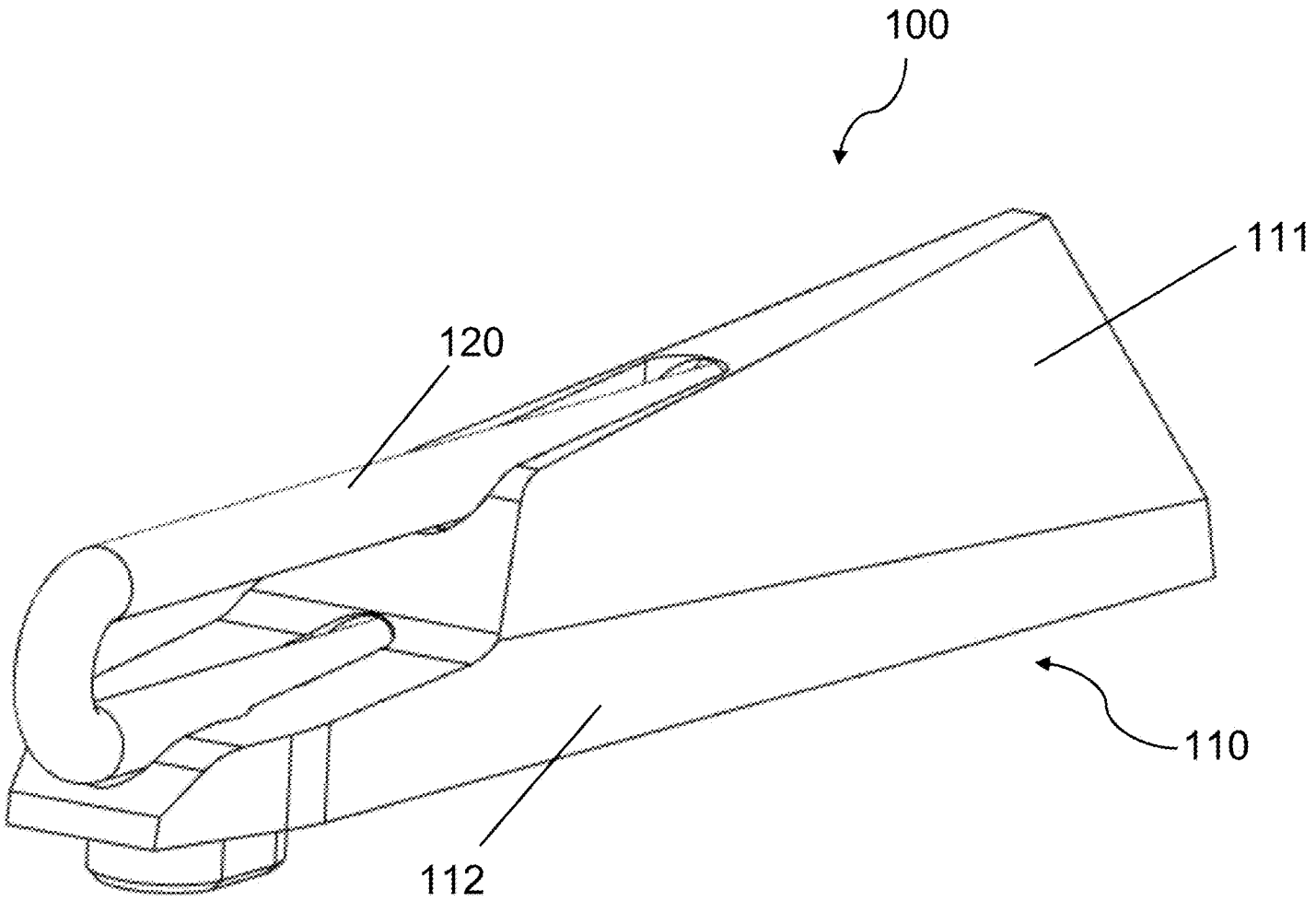
FIG. 1 is a schematic view of the gun tunnel sight in the present invention.
Figure 2:
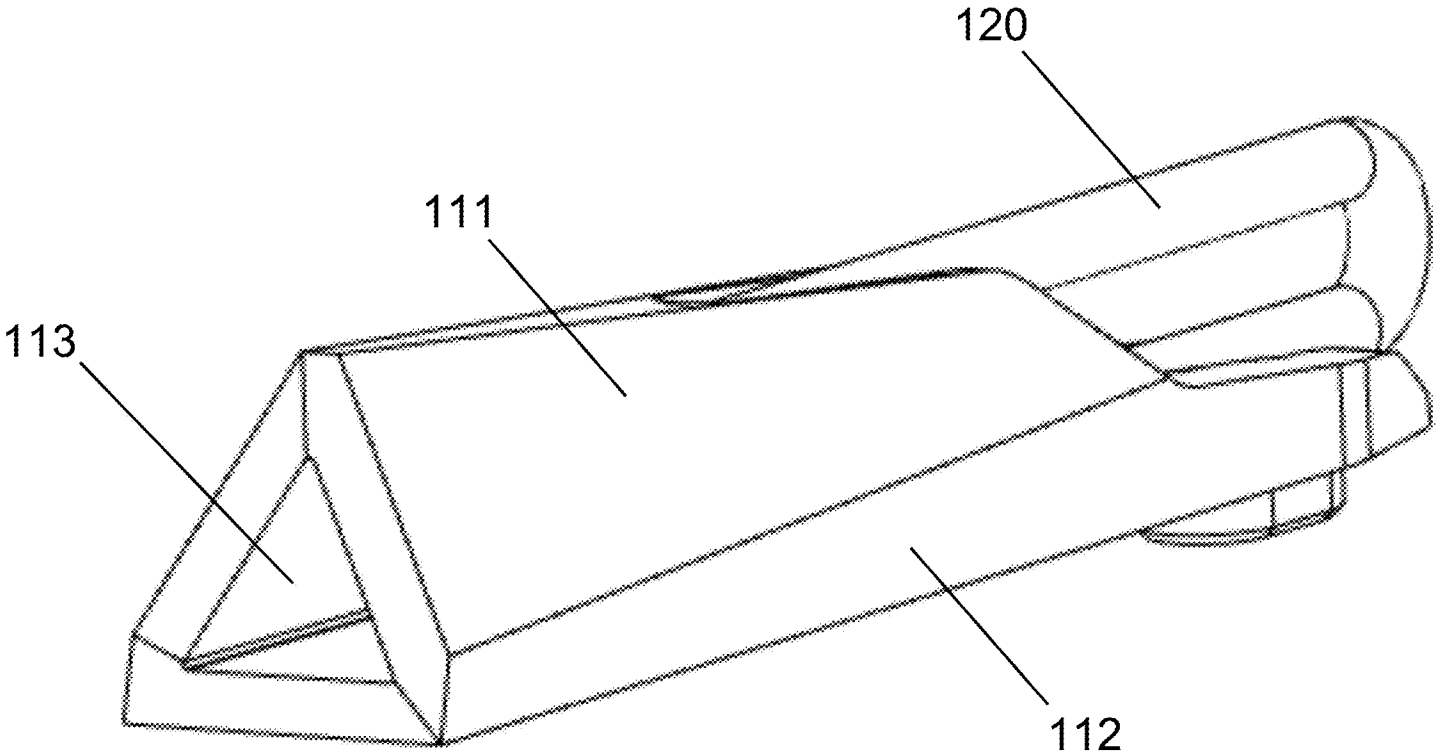
FIG. 2 is a schematic view from another angle of the gun tunnel sight in the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

In one aspect, referring to FIGS. 1 to 4, a gun sight may include a main body 110 and a light tube 120. In one embodiment, the main body may include an elongated tapered light tunnel housing 111 and a base 112, wherein the light tunnel housing 111 is formed on top of the base 112, and a light tunnel 113 is formed inside the light tunnel housing 111.

Figure 3:
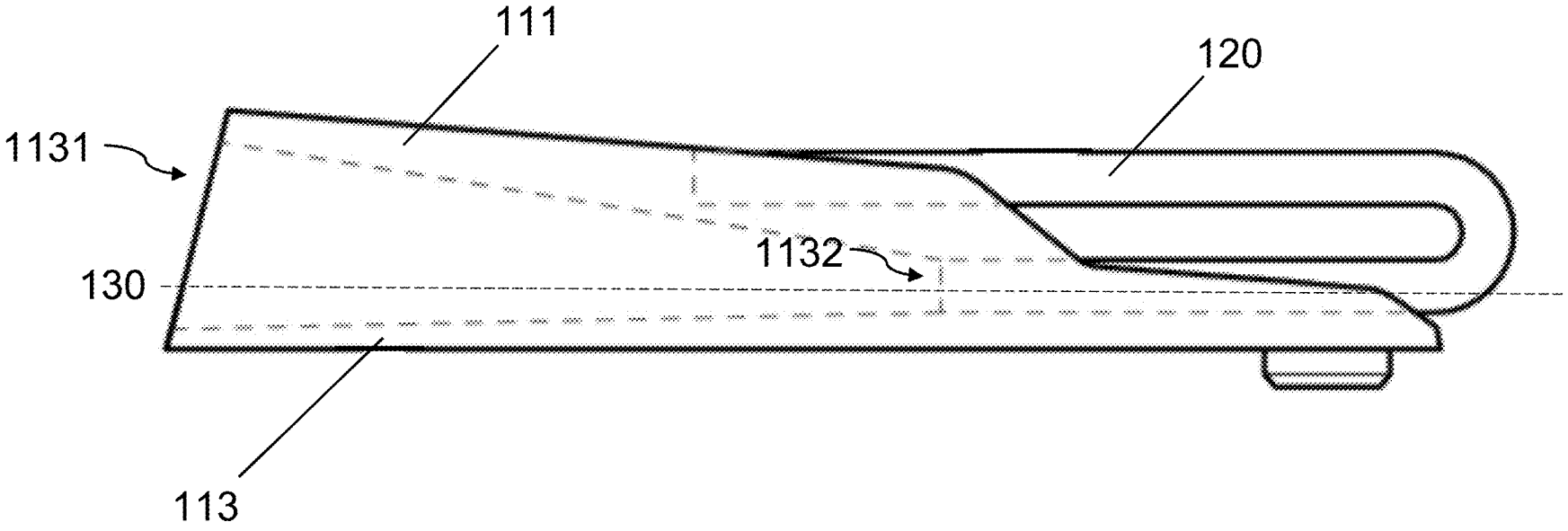
FIG. 3 is a schematic view of the light tunnel of the gun tunnel sight in the present invention.

In an exemplary embodiment, as shown in FIG. 3, the light tunnel 113 has a front end 1131 and a rear end 1132, and the light tube 120 is disposed at the rear end 1132 of the light tunnel 113. In one embodiment, the light tube 1132 can be a fluorescent optical fiber that can be used as a light source for the shooter's eye even when the environment is relatively dark. In other embodiments, the light tube 120 can be an integration of optical fiber and tritium.

It is important to note that the light tunnel 113 in the present invention is tapered from the front end 1131 to the rear end 1132 as shown in FIG. 3, to enhances the effect of light concentration in the light tunnel 113. In other words, comparing with conventional gun sights, the size of the light tunnel 113 can be shorted because it is tapered to enhance light concentration, and the size of the gun sight 100 in the present invention can be further minimized without sacrificing the functionality thereof. It is also noted that the shape of the light tunnel 113 is not limited to triangular as shown in FIGS. 2 to 5. It can be circular or any other polygonal.

Figure 4:
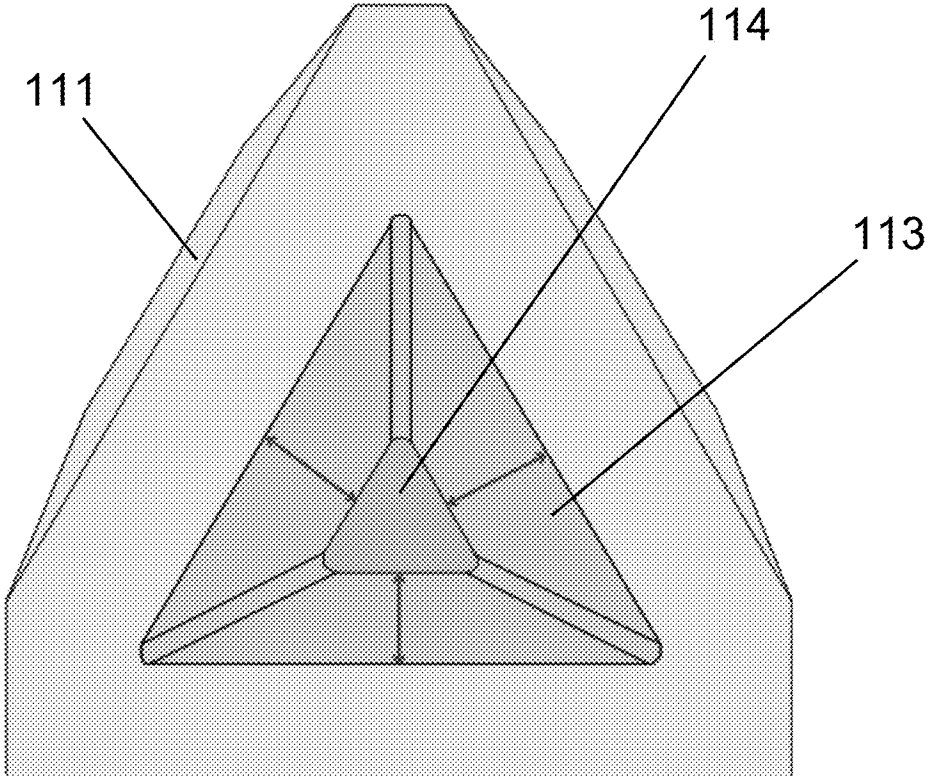
FIG. 4 is a partial enlarging view from a front end of the light tunnel of the gun tunnel sight in the present invention.
Figure 5:
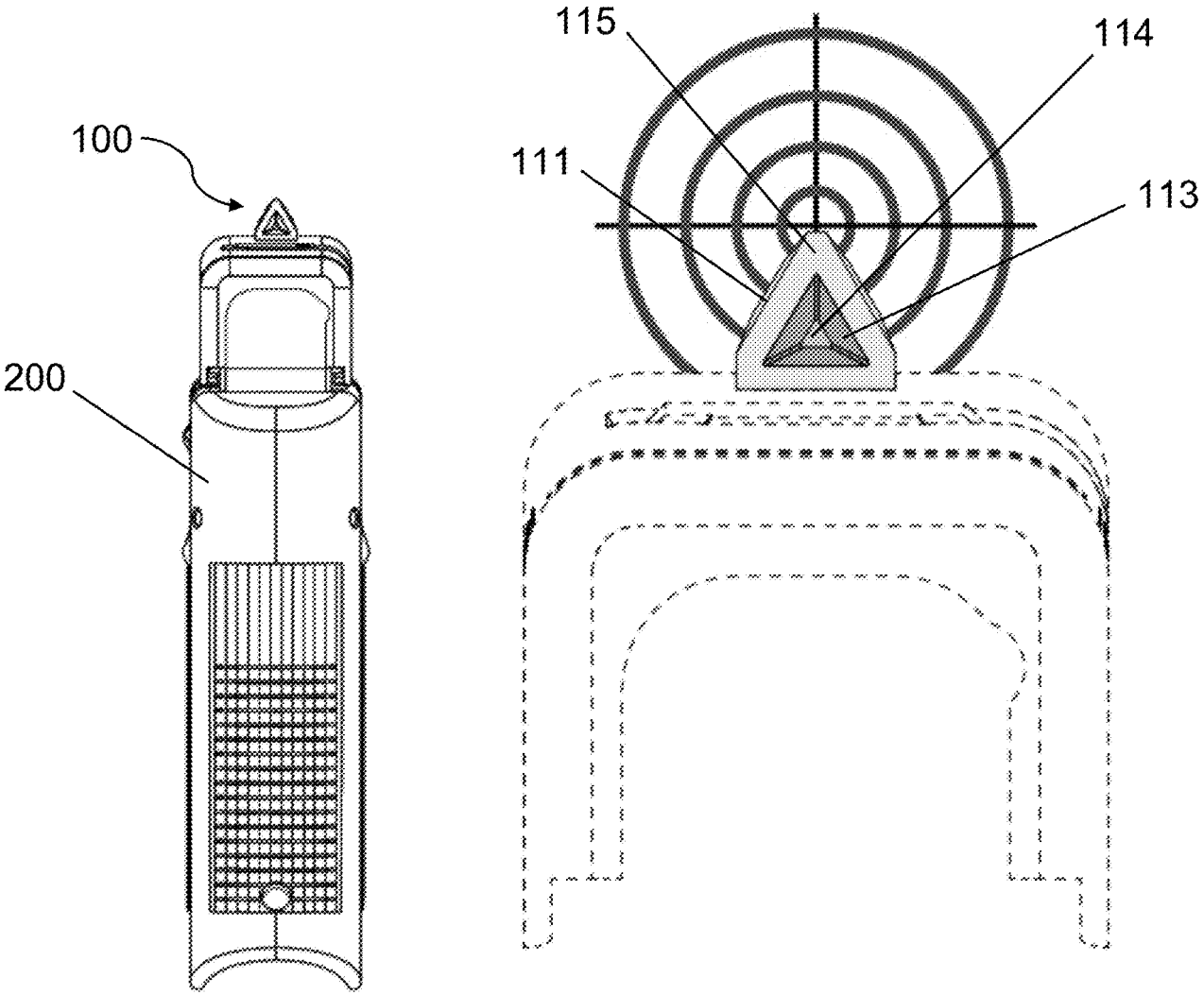
FIG. 5 is a schematic view of the gun tunnel sight in the present invention disposed on a pistol for aiming a target.
Figure 6:
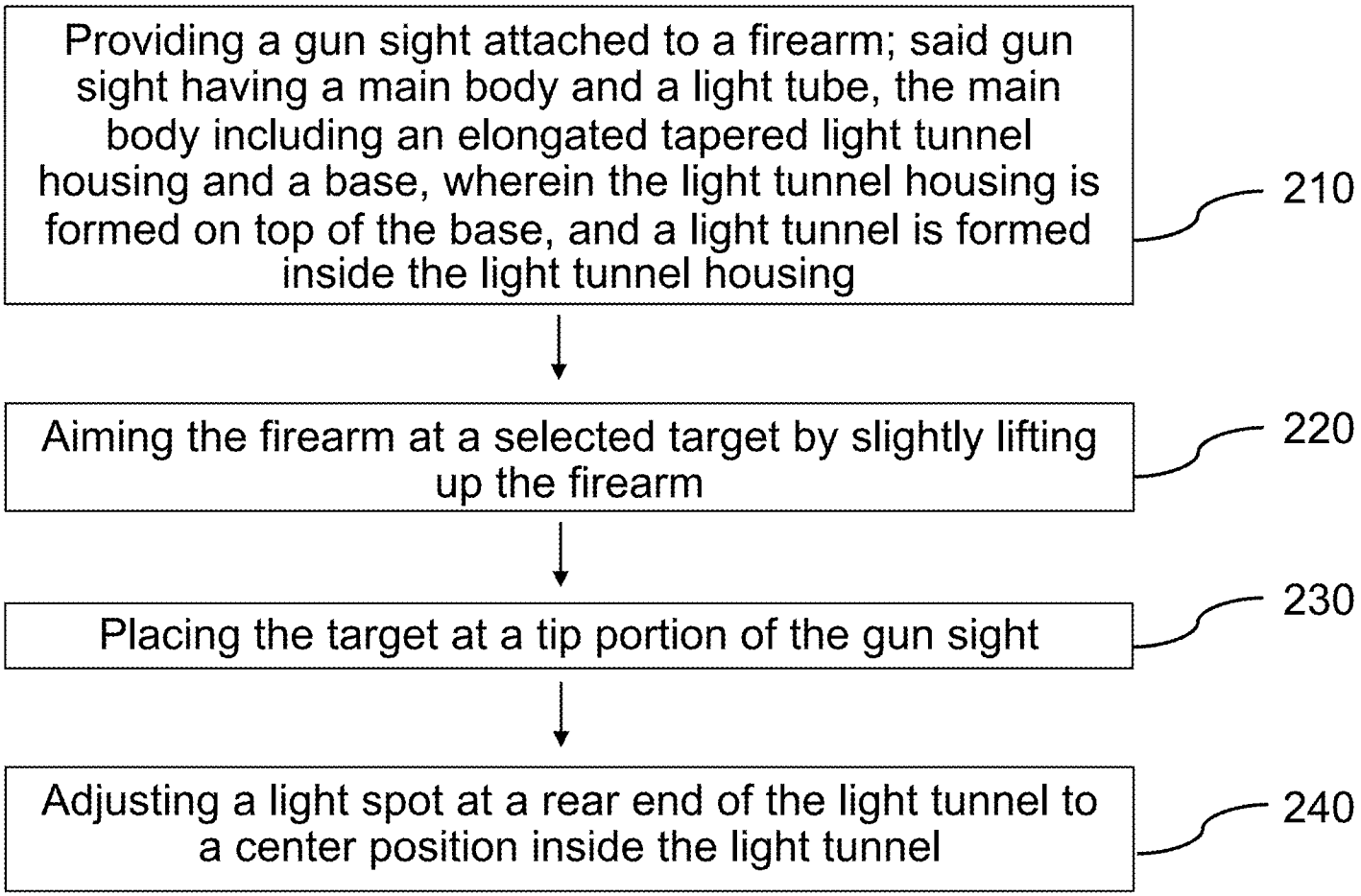
FIG. 6 is a method for aiming a target with a firearm using the gun sight in the present invention.

When in use, instead of using conventional double sights (front and rear), the user can merely dispose the gun tunnel sight 100 on the pistol 200 as shown in FIG. 5. Through the light tunnel 113, the shooter can see a light spot, i.e. a small inner triangle 114 at the rear end 1132 of the light tunnel 113, and point the pistol 200 to the target and place target on a tip portion 115 of the tunnel sight 100. More importantly, the shooter may need to align the inner triangle 114 inside the light tunnel 113 to be centrally disposed so that the inner triangle is equally spacing to all sides as shown in FIGS. 4 and 5.

In another aspect, a method for aiming a target with a firearm may include steps of: providing a gun sight attached to a firearm (210); said gun sight having a main body and a light tube, the main body including an elongated tapered light tunnel housing and a base, wherein the light tunnel housing is formed on top of the base, and a light tunnel is formed inside the light tunnel housing; aiming the firearm at a selected target by slightly lifting up the firearm (220); placing the target at a tip portion of the gun sight (230); and adjusting a light spot at a rear end of the light tunnel to a center position inside the light tunnel (240).

In one embodiment, the shape of the light tunnel is, but not limited to triangle, circle or other polygons. In another embodiment, the light tube is a fluorescent optical fiber that can be used as a light source for the shooter's eye even when the environment is relatively dark. In a further embodiment, the light tube is an integration of optical fiber and tritium.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A gun sight comprising:

a light tube; and a main body including an elongated tapered light tunnel housing and a base; said light tunnel housing formed on top of the base, and a light tunnel formed inside the light tunnel housing; said light tunnel having a front end and a rear end;

wherein the light tunnel is tapered from the front end to the rear end to enhance light concentration in the light tunnel so the size of the light tunnel can be shortened and the size of the gun sight can be further minimized, wherein the shape of the light tunnel is selected from a group consisting of triangle, circle or other polygons.

2. The gun sight of claim 1, wherein the light tube is a fluorescent optical fiber that can be used as a light source for the shooter's eye even when the environment is relatively dark.

3. The gun sight of claim 1, wherein the light tube is an integration of optical fiber and tritium.

4. A method for aiming a target with a firearm comprising steps of:

providing a gun sight attached to a firearm; said gun sight having:

a main body; and a light tube, wherein main body includes an elongated tapered light tunnel housing and a base; the light tunnel housing is formed on top of the base, and a light tunnel is formed inside the light tunnel housing;

aiming the firearm at a selected target by slightly lifting up the firearm;

placing the target at a tip portion of the gun sight; and adjusting a light spot at a rear end of the light tunnel to a center position inside the light tunnel.

5. The method for aiming a target with a firearm of claim 4, wherein the shape of the light tunnel is, but not limited to triangle, circle or other polygons.

6. The method for aiming a target with a firearm of claim 4, wherein the light tube is a fluorescent optical fiber that can be used as a light source for the shooter's eye even when the environment is relatively dark.

7. The method for aiming a target with a firearm of claim 4, wherein the light tube is an integration of optical fiber and tritium.

* * * * *